US008122974B2

(12) United States Patent
Kosoric

(10) Patent No.: US 8,122,974 B2
(45) Date of Patent: Feb. 28, 2012

(54) APPARATUS FOR DRILLING MACHINE ALIGNMENT

(76) Inventor: Dragan Kosoric, Winnipeg (CA)

( * ) Notice: Subject to any disclaimer, the term of this patent is extended or adjusted under 35 U.S.C. 154(b) by 242 days.

(21) Appl. No.: 12/170,736

(22) Filed: Jul. 10, 2008

(65) Prior Publication Data

US 2010/0006337 A1 Jan. 14, 2010

(51) Int. Cl.
*E21B 44/00* (2006.01)
*E21B 7/02* (2006.01)
*B23Q 5/00* (2006.01)

(52) U.S. Cl. ..... 175/24; 175/45; 173/1; 173/2; 173/4; 173/11; 173/20

(58) Field of Classification Search ..... 175/24, 175/45; 173/1, 2, 4, 11, 20
See application file for complete search history.

(56) References Cited

U.S. PATENT DOCUMENTS

| | | | | |
|---|---|---|---|---|
| 3,721,304 | A * | 3/1973 | Hanson | 173/2 |
| 3,896,885 | A * | 7/1975 | Dahlstrom et al. | 173/2 |
| 4,022,284 | A * | 5/1977 | Crow | 173/2 |
| 4,343,367 | A * | 8/1982 | Mashimo | 173/190 |
| 4,364,540 | A * | 12/1982 | Montabert | 248/654 |
| 4,514,796 | A * | 4/1985 | Saulters et al. | 700/13 |
| 4,698,570 | A * | 10/1987 | Satoh | 318/568.19 |
| 4,858,700 | A * | 8/1989 | Shafer | 173/185 |
| 5,279,372 | A * | 1/1994 | Rinnemaa | 175/24 |
| 5,348,105 | A | 9/1994 | Lappalainen | |
| 5,383,524 | A * | 1/1995 | Rinnemaa | 173/1 |
| 5,893,421 | A * | 4/1999 | Lemmetty | 173/193 |
| 6,829,835 | B2 * | 12/2004 | Pfeil | 33/333 |
| 6,896,072 | B2 * | 5/2005 | MacDonald | 173/192 |
| 7,267,182 | B2 * | 9/2007 | Saha | 173/2 |
| 7,530,176 | B2 * | 5/2009 | Shotton et al. | 33/544 |
| 7,644,782 | B1 * | 1/2010 | Coogan et al. | 173/1 |
| 7,681,660 | B2 * | 3/2010 | Muona | 173/4 |
| 2009/0065258 | A1 * | 3/2009 | Hamilton | 175/61 |
| 2009/0266610 | A1 * | 10/2009 | Farley | 175/45 |
| 2010/0006337 | A1 * | 1/2010 | Kosoric | 175/24 |

FOREIGN PATENT DOCUMENTS

WO WO 2007073327 A1 * 6/2007

* cited by examiner

*Primary Examiner* — Jennifer H Gay
(74) *Attorney, Agent, or Firm* — Adrian D. Battison; Ade & Company Inc.

(57) ABSTRACT

Apparatus for controlling a drilling machine to drill a series of parallel holes, where the drilling machine comprises a carrier vehicle movable over the terrain, a boom mounted on the vehicle for movement side to side on the vehicle, a mast carried on an outer end of the boom and movable about two separate axes relative to the end of the boom, includes a first sensor responsive to an azimuth angle relative to the earth's magnetic north direction and two additional sensors, which are used to measure the two inclinations relative to two vertical planes transverse to and longitudinal of the boom. The sensor system is mounted in an housing on the mast close to the longitudinal center of the mast and offset to the side. A controller calculates from the sensed values of the azimuth and inclination angles required target angles for the mast for drilling each hole.

13 Claims, 5 Drawing Sheets

APPARATUS FOR DRILLING MACHINE ALIGNMENT

This invention relates to an apparatus for aligning a drilling mast assembly of a drilling vehicle.

BACKGROUND OF THE INVENTION

In U.S. Pat. No. 5,348,105 (Lappalainen) assigned to Tamrock Oy and issued Sep. 20, 1994 is disclosed a method for alignment of a drill mast in a drilling operation of the general type with which the present invention is concerned.

Typically a drilling machine includes a carrier vehicle movable on tracks over rough terrain and carrying a boom which can be rotated around a vertical axis or joint to left and right. At the end of the boom is mounted a mast for a drilling tool so that the angle of the mast defines the drilling direction. The mast is mounted on the boom for pivotal movement about two axes with respect to the vertical so that its position forward and rearwardly and its position side to side can be adjusted. Such a machine is commonly used in an excavation process.

In excavation, drilling is usually performed by drilling parallel holes side by side in a row where the holes lie in a common shearing plane which is generally perpendicular to the direction of excavation across the area to be excavated. The holes are then charged and blasting is carried out along the shear plane to extract rock in front of that shear plane.

In order to ensure that the excavation takes place in a desired manner, the drill holes have to be positioned sufficiently accurately in the shearing or excavation plane in question and in parallel with it as the excavation is designed to be performed in a predetermined order. Control and measuring devices are used to position the drilling machine of the rock drilling equipment in a desired direction with a desired inclination. Such devices indicate the angle of inclination of the mast of the drilling machine in two planes perpendicular to each other. For example, the angle can be indicated in a first vertical plane extending in the longitudinal direction of the boom and in a second vertical plane transverse to the end of the boom, so that the mast can be positioned at a desired angle with respect to the vehicle.

For the drilling process, the directional angles of the mast and thus those of the drill rod are calculated and determined as inclinations in the drilling direction. This is inconvenient and complicated, but there are aligning devices developed for indicating the direction of the mast and thus that of the drill rod in a desired manner with respect to the vehicle.

In the above patent there is shown a method which uses a reference direction along a sight line to a remote visible stationary target selected so that the target and thus the sight line is determinable in every drilling position of the vehicle in the alignment. An angle between the reference direction and the drilling direction is determined after the first drilling position of the drilling equipment on the basis of the reference direction. The angle between the longitudinal direction of the vehicle and the drilling direction is determined, and the mast is aligned on the basis of the angle so determined so that it is parallel with the drilling direction and the drilling plane.

SUMMARY OF THE INVENTION

The object of the present invention is to provide a method and equipment for aligning a drilling process, which are simple and easy to use.

According to one aspect of the invention there is provided an apparatus for controlling a drilling machine for drilling a series of holes where the drilling machine comprises a carrier vehicle movable over the terrain, a boom mounted on the vehicle for movement side to side on the vehicle, a mast for supporting a drilling tool where the mast is carried on an outer end of the boom and movable about two separate axes relative to the end of the boom, the apparatus comprising:

a sensor assembly;

the sensor assembly including a first sensor responsive to the earth's magnetic north direction to provide an output indicative of an azimuth angle between Magnetic North and a predetermined orientation of the sensor assembly;

the sensor assembly including two second sensors each providing an output indicative of an inclination angle of the sensor assembly with respect to respective vertical planes;

the sensor assembly being mounted on the mast;

and a controller responsive to the outputs of the first and second sensors arranged to determine a set of angles for the mast for drilling each holes of the series of holes.

Preferably the sensor assembly is mounted in a housing which is attached to the mast.

Preferably the sensor assembly is mounted on the mast by using a support arm which locates the sensor assembly at a position spaced from the mast. However the sensor assembly can also be mounted directly on the mast and the field generated by the mast compensated in the software.

Preferably the sensor assembly is mounted close to a longitudinal center of the mast since this minimizes the effect to the field of the mast. However other locations are also possible.

Preferably the support arm is formed of a non-ferromagnetic material which is also resistant to flexing under vibration, such as wood or fiber reinforced plastic material and more preferably from a glass fiber reinforced plastic structural tubing which has virtually no whip-effect when vibrations from the mast are introduced.

Preferably the support arm extends to one side of the mast where the side is at right angles to a front face of the mast which carries the drilling tool, although other locations are possible.

According to a second aspect of the invention there is provided a method for drilling a series of holes using a drilling machine which comprises a carrier vehicle movable over the terrain, a boom mounted on the vehicle for movement side to side on the vehicle, a mast for supporting a drilling tool where the mast is carried on an outer end of the boom and movable about two separate axes relative to the end of the boom, the method comprising:

providing a sensor assembly including a first sensor responsive to the earth's magnetic north direction to provide an output indicative of an azimuth angle between Magnetic North and a predetermined orientation of the sensor assembly;

the sensor assembly including two second sensors each providing an output indicative of an inclination angle of the sensor assembly with respect to respective vertical planes;

the sensor assembly being mounted on the mast;

locating the drilling machine at a first location and orienting the mast at the location to drill a first one of the holes in a desired direction;

sensing the azimuth angle and the inclination angles of the mast at the first location;

moving the drilling machine to a second location;

sensing the azimuth angle and the inclination angles of the mast at the second location;

calculating a target azimuth angle and two target inclination angles using a controller;

and operating movement of the boom and mast to move the mast to the azimuth angle and inclination angles required to drill a second one of the holes in a desired direction.

The concept herein is that no stationary visible reference point and hence no action is required by the operator to locate such a point and to generate the line of sight with respect to that reference point. With the present arrangement as described hereinafter the mast can be moved in full 360 degree of direction without the need for sighting to a fixed reference point. The reference direction is defined instead by the earth's magnetic field direction. The sensor package includes a sensor which carries out a measurement of the angle of azimuth with respect to north together with further sensors which detect two inclination angles with respect to perpendicular vertical planes.

In a typical situation where the next drilling direction is intended to be parallel to an original drilling direction, the angle of azimuth together with the inclination angles at the original drilling direction are stored in a memory.

When the vehicle has been moved into a new drilling position, the operator only has to move the mast and boom to position the mast over the next drilling location, and the mast is turned so that it is at the angles stored in the memory with respect to the original drilling direction. This is achieved by taking the sensor readings including the azimuth and two inclination angles, which are then stored, and by using a controller which effects a recalculation of target values of azimuth and inclination using standard mathematical and trigonometric relations in order to provide the necessary position of the sensor and mast to align the mast to the previous hole. The values are then displayed to the operator as the TARGET values which the operator has to take to achieve the desired inclination of the mast in the plane of excavation. Advantages of the method and the equipment according to the invention are that they are simple, reliable, easy to use and economical.

It is not necessary to have the sensor or mast turned in all cases to be parallel to the original drilling direction in order to use the present system. It also can be used where the sensor and mast is intended to be set at any position. In addition, while a parallel position may be desired, there may be in some cases positions where a solution does not exist because of the limitations of the machine and the sensors.

Only one specialized sensor package attached directly or indirectly to the mast is required to measure and supply the input data to the controller.

The sensor package, consisting of two angle and one azimuth sensors, located on the drill's mast by a mounting arm, are used to measure the two inclinations in vertical drilling planes and drilling direction angle respectively. Sensors are packaged in a single enclosure and are mounted on the drill's mast by using a non-metallic mounting arm.

The sensor package can also be mounted directly on the mast without using a mounting arm to space the sensor package from the mast. While the indirect mounting using a mounting arm of a non-metallic or at least non-ferromagnetic construction is preferred to avoid the interference with the magnetic sensor by the field generated by the mast, it is also possible to mathematically compensate for a constant magnetic filed generated by the mast.

The position of the sensor is preferably parallel with the drilling direction defined by the mast although this is not essential since a mathematical compensation for a different angle can be used. This location on the mast eliminates the need to observe measure, collect and process the angular position of the boom and the operator's cab relative to a visual targeting device inside the cab.

Drill rigs generally contain numerous electrical and mechanical systems that, by the nature of their design or nature of their integration create the strong local magnetic fields. Those fields affect the ferrous metal components of the rig and the entire drill machine can become somewhat magnetized. Different parts of the drill structure show different magnetic readings. The magnetic field of the mast is the one that could negatively affect the efficiency of the sensor reading.

It is desirable therefore that the sensor package should be mounted close to the longitudinal center of the mast, and preferably offset to one side of the mast. This is because of the shape of the magnetic field created around a magnet, so that, at a position in the middle of the length of the magnet, magnetic force is small or zero. For best operation, a position offset to one side of the mast in the range 0.1 inches to 5.0 feet is suitable although a more suitable distance lies in the range 2.0 to 3.0 feet.

Magnetic fields, of course, travel through magnetic conductive materials, and there is no possible way to stop or eliminate it. Although, some shielding is available, success rate using this technique is less satisfactory and thus is undesirable. Two major problems are faced with using the magnetic sensor on the drilling rigs; firstly the entire mast is built out of magnetic conductive ferrous metal and secondly there are constant vibrations present in the mast.

To minimize the magnetic influence, the mounting of the sensor package is preferably built out of non-ferromagnetic material such as wood, plastic or some less magnetic conductive metal.

To minimize the vibration effect too, the mounting of the sensor package is preferably of a material such as wood or special fiber plastic material. In particular a design using a fiberglass structural tubing is preferred as it is light and has virtually no whip-effect when vibrations are introduced.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1B:
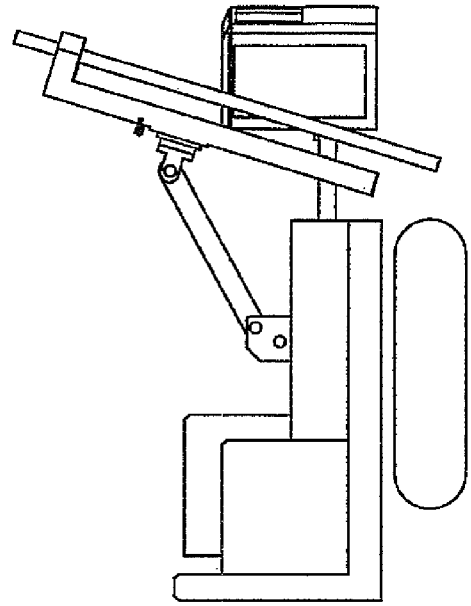
FIGS. 1A, 1B and 1C are side elevational views which illustrate schematically a rock drilling device in accordance with the present invention showing three positions of the "dump" or "dip" angle of the mast relative to a vertical plane transverse to the boom.
Figure 1C:
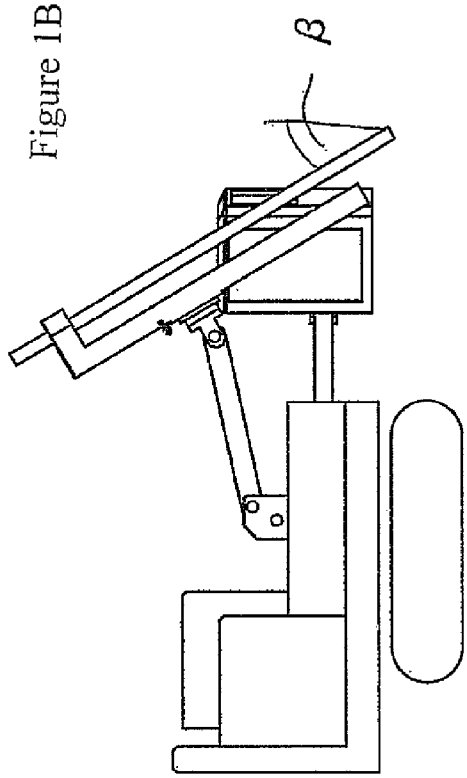
Figure 1A:
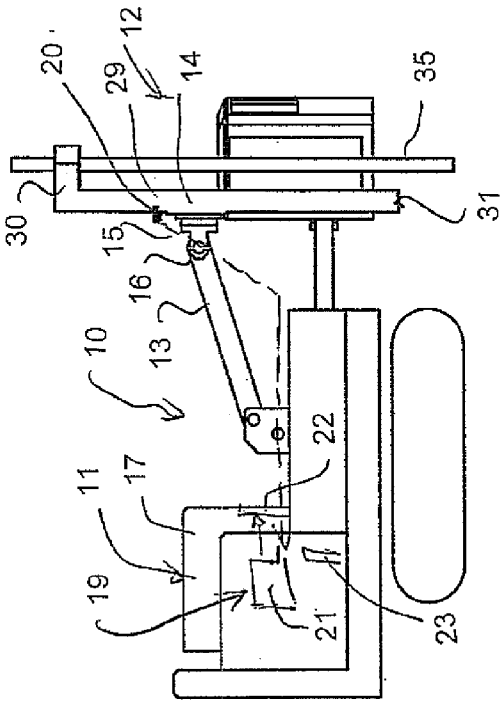

An earth drilling machine 10 is shown generally in FIG. 1 includes a self propelled off-road featured vehicle 11 of a size commonly used in the utility industry which provides a mobile base for drilling longitudinal holes. The tracked or wheeled-vehicle 11 has an elongated structure, with a drilling apparatus 12 mounted on the front of the vehicle 11. The operator sits in a cab 17 which is mounted to one side of the vehicle. The drilling apparatus includes a boom 13 which is highly movable in side to side and up and down movement to reduce the need for maneuvering the vehicle. This is possible by mounting a drill mast 14 on the articulating boom 13 and attaching the mast 14 to the end of the boom 13 by using the two rotating joints 15/16 located in two vertical perpendicular planes. The vehicle has means for providing hydraulic and/or compressed air forces for moving the boom and mast.

Common rock drilling practice often requires an accurate holes drilling pattern. Such pattern usually consists of number of holes drilled to be parallel and in the same inclined plane. The drilling machine moves from one drilling position to another and changes the azimuth (heading) which is the angle relative to Magnetic North.

The drilling machine includes an apparatus 19 for controlling the drilling machine so as to allow the operator to control the orientation of the mast and therefore the drilling tool. This includes a sensor assembly 20 communicating with a controller 21 in the cab and a display 22 for providing information from the controller to the operator so that the operator can control the position and movement of the drilling machine using controls 23.

The sensor assembly including a first sensor 24 responsive to the earth's magnetic north direction to provide an output indicative of an azimuth angle between Magnetic North and a predetermined orientation of the sensor assembly. The sensor assembly including two second sensors 25, each providing an output indicative of an inclination angle of the sensor assembly with respect to respective vertical planes. The sensor assembly is mounted on the mast in a housing 26 which is attached to the mast by using a support arm 27 which locates the sensor assembly at a position spaced from the mast.

In order to minimize the effect to the magnetic field of the mast, the sensor assembly is mounted close to a longitudinal center of the mast at an area 29 approximately mid way between ends 30 and 31 of the mast.

The support arm is formed of a non-ferromagnetic material which is resistant to flexing under vibration. Suitable materials include wood and fiber reinforced plastic material. In particular the support arm is formed from a glass fiber reinforced plastic structural tubing 32 which has virtually no whip-effect when vibrations from the mast are introduced.

The support arm extends to one side 33 of the mast where the side is at right angles to a front face 34 of the mast which carries the drilling tool 35.

Figure 2A:
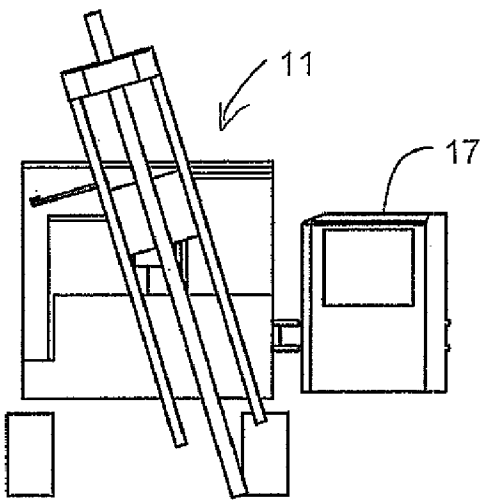
FIGS. 2A, 2B and 2C are front elevational views which illustrate schematically the rock drilling device of FIG. 1A, showing three positions of the "ring" or "swing" angle of the mast relative a vertical plane longitudinal to the boom.
Figure 2B:
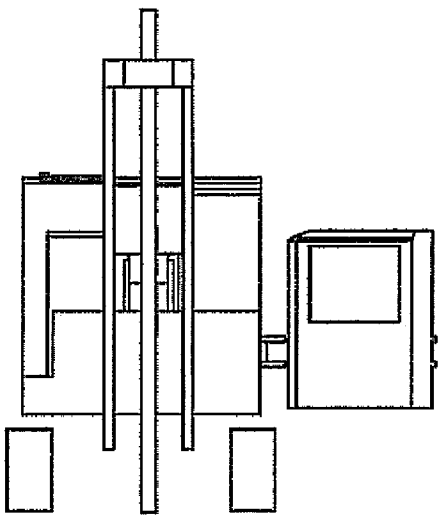
Figure 2C:
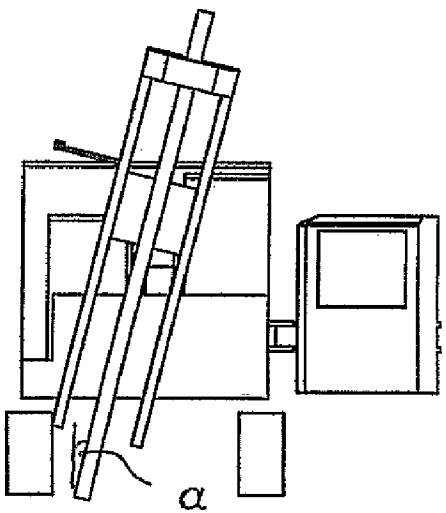
Figure 4:
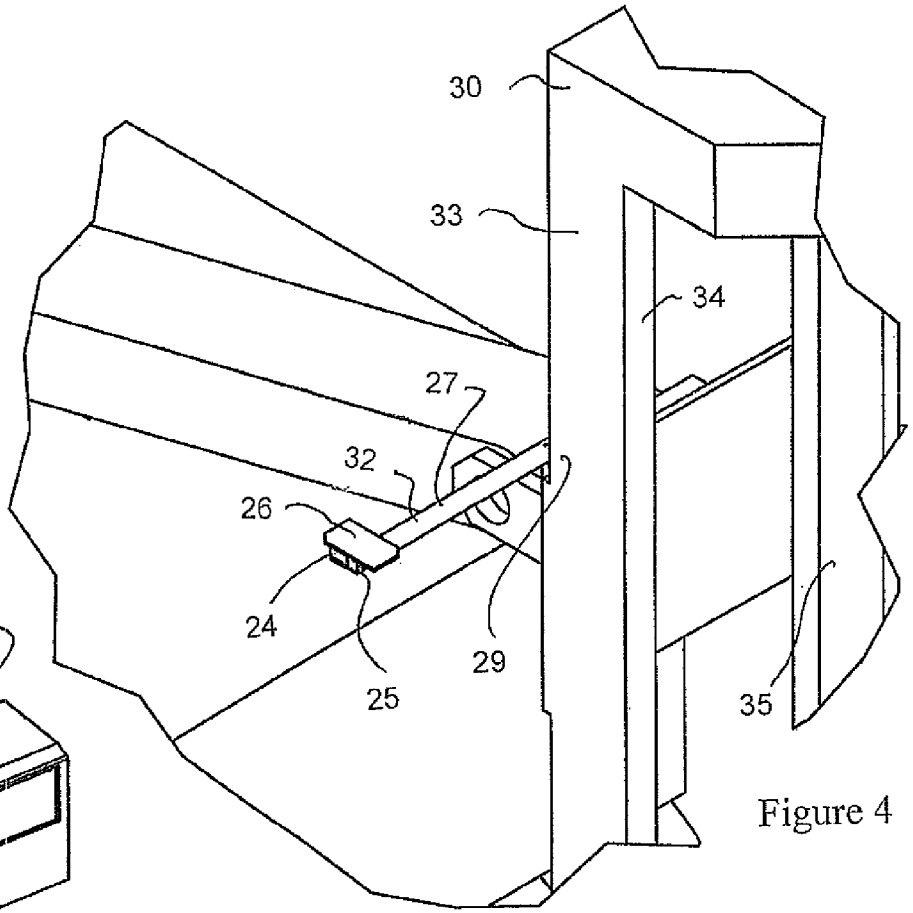
FIG. 4 is an isometric view on an enlarged scale of the mounting of the sensor package on the mast.
Figure 3:
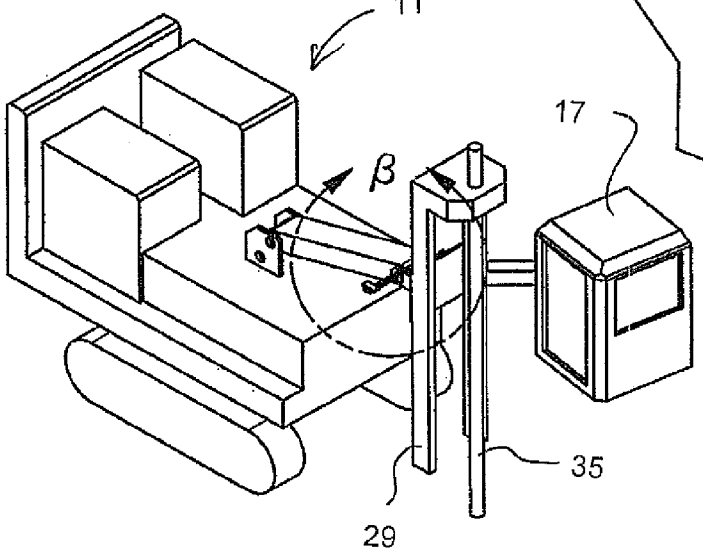
FIG. 3 is an isometric view of the drilling device of FIG. 1A showing the mounting of the sensor package on the mast.
Figure 6:
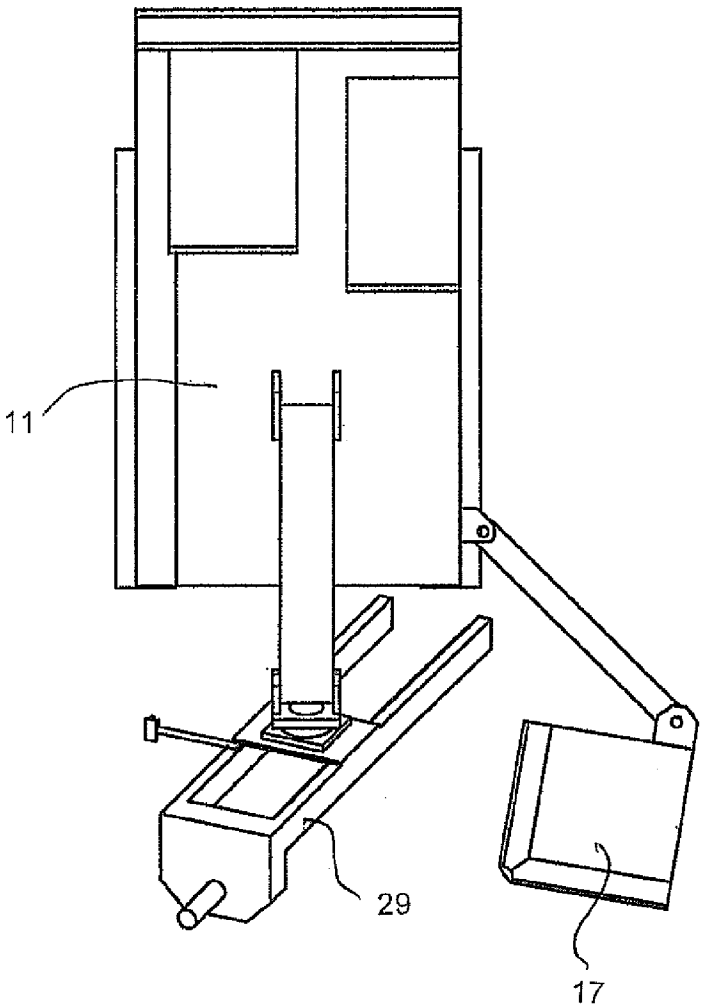
FIG. 6 is a top plan view of the drilling device of FIG. 1A showing the mounting of the sensor package on the mast.
Figure 5:
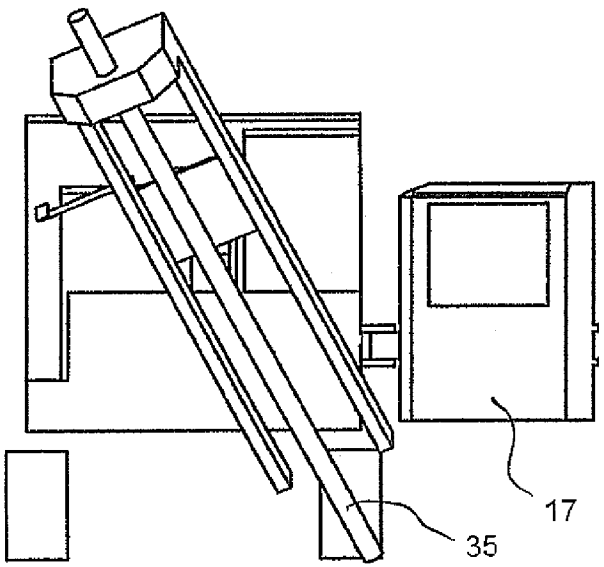
FIG. 5 is a front elevational view of the drilling device of FIG. 1A showing the mounting of the sensor package on the mast.
Figures 7A, 7B, 7C:
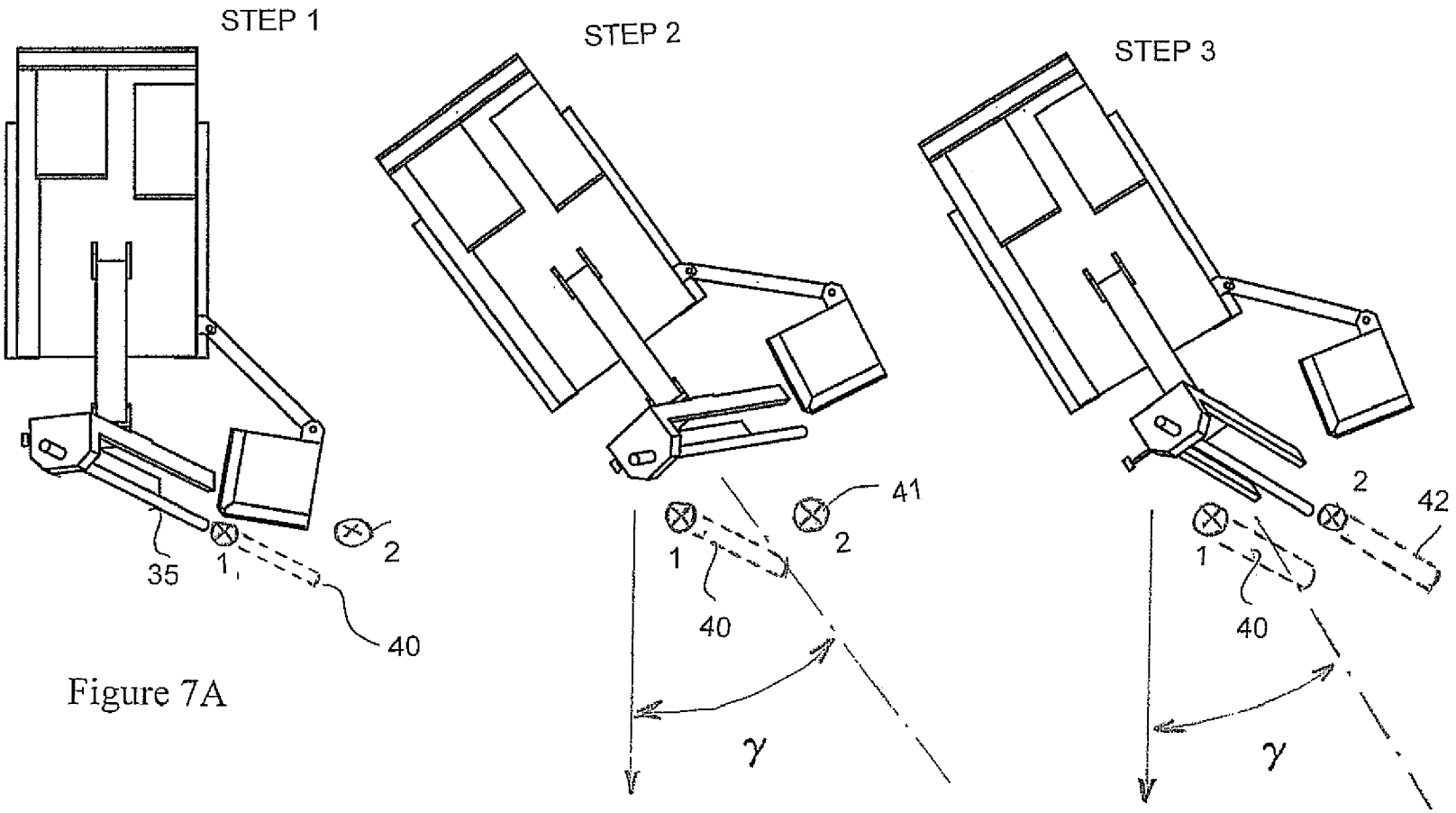
FIGS. 7A, 7B and 7C show the steps in moving the drilling device using the angles from the sensed values obtained from the sensor.

In operation as shown in the series of steps illustrated in FIGS. 7A, 7B and 7C, the drilling machine is located at a first location and the mast is oriented at the location to drill a first one 40 of the set of holes in a desired direction. In this starting position with the drilling tool set in the required direction, the ring angle $\alpha$ (FIG. 2C) and the dump angle $\beta$ (FIG. 1C) are detected by the inclination sensors 25; and the azimuth angle $\gamma$ (FIGS. 7B, 7C) is detected by the sensor 24.

As shown in the step illustrated in FIG. 7B, the drilling machine is moved to a second location 41. This is achieved by rotating the machine and the boom but could be achieved by physically relocating the machine depending on the distance required.

At the second location 41 the azimuth angle and the inclination angles of the mast are sensed by the sensors 24 and 25 and communicated to the controlled 21.

The controller is used to calculate from the required direction and location of the intended second hole 42 a target azimuth angle and two target inclination angles and the operator controls the movement of the boom and mast to move the mast to the azimuth angle and inclination angles required to drill the second hole 42 in a desired direction.

The mast is an elongated guide which is rotatably attachable to the boom via the rotatable coupling, enabling the drill to be rotated in two vertical planes transversely and longitudinally of the boom to a convenient angle. The drilling tool is mounted on a longitudinal front face 17 of the mast.

This invention eliminates the need to measure the angle determined on the basis of an angle between the boom and the longitudinal direction of the vehicle and an angle between the longitudinal direction of the vehicle and the drilling direction. In other words, positions of the vehicle and/or the drill boom and/or the operator's cab are irrelevant thus are not monitored.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. In a drilling machine for drilling a series of holes where the drilling machine comprises:

a carrier vehicle movable over the terrain, a boom mounted on the vehicle for movement side to side on the vehicle, a mast for supporting a drilling tool where the mast is carried on an outer end of the boom and movable about two separate axes relative to the end of the boom, the improvement of an apparatus for controlling the drilling machine comprising:

a sensor assembly;

the sensor assembly including a first sensor responsive to the earth's magnetic north direction to provide an output indicative of an azimuth angle between Magnetic North and an orientation of the sensor assembly;

the sensor assembly including two second sensors each providing an output indicative of an inclination angle of the sensor assembly with respect to a respective one of two vertical planes arranged at an angle to one another, where the vertical planes are perpendicular to the earth's surface;

the sensor assembly being mounted on the mast;

and a controller responsive to the outputs of the first sensor and the two second sensors arranged to determine a set of angles, including a target azimuth angle and two target inclination angles, for the mast for drilling each holes of the series of holes;

where the set of angles including the target azimuth angle and two target inclination angles are determined after the carrier vehicle is moved.

2. The apparatus according to claim 1 wherein the sensor assembly is mounted in a housing which is attached to the mast.

3. The apparatus according to claim 1 wherein the sensor assembly is mounted on the mast by using a support arm which locates the sensor assembly at a position spaced from the mast.

4. The apparatus according to claim 3 wherein the support arm is formed of a non-ferromagnetic material.

5. The apparatus according to claim 3 wherein the support arm is formed of a material which is resistant to flexing under vibration.

6. The apparatus according to claim 3 wherein the support arm is formed from wood.

7. The apparatus according to claim 3 wherein the support arm is formed from fiber reinforced plastic material.

8. The apparatus according to claim 3 wherein the support arm is formed from a glass fiber reinforced plastic structural tubing which has virtually no whip-effect when vibrations from the mast are introduced.

9. The apparatus according to claim 3 wherein the support arm extends to one side of the mast where the side is at right angles to a front face of the mast which carries the drilling tool.

10. The apparatus according to claim 3 wherein the first and second sensors are carried in a housing at an end of the support arm spaced from the mast.

11. The apparatus according to claim 1 wherein the sensor assembly is mounted close to a longitudinal center of the mast.

12. A method for drilling a series of holes using a drilling machine which comprises a carrier vehicle movable over the terrain, a boom mounted on the vehicle for movement side to side on the vehicle, a mast for supporting a drilling tool where the mast is carried on an outer end of the boom and movable about two separate axes relative to the end of the boom, the method comprising:

providing a sensor assembly including a first sensor responsive to the earth's Magnetic North direction to provide an output indicative of an azimuth angle between Magnetic North and an orientation of the sensor assembly;

the sensor assembly including two second sensors each providing an output indicative of an inclination angle of the sensor assembly with respect to a respective one of two vertical planes arranged at an angle to one another, where the vertical planes are perpendicular to the earth's surface;

the sensor assembly being mounted on the mast;

locating the drilling machine at a first location and orienting the mast at the location to drill a first one of the holes in a desired direction;

sensing the azimuth angle and the inclination angles of the mast at the first location;

moving the drilling machine to a second location;

sensing the azimuth angle and the inclination angles of the mast at the second location;

calculating a target azimuth angle and two target inclination angles using a controller;

and operating movement of the boom and mast to move the mast to the azimuth angle and inclination angles required to drill a second one of the holes in a desired direction.

13. The method according to claim 12 wherein the second hole is parallel to the first hole.

* * * * *